United States Patent [19]
Shihabi et al.
[11] 4,443,327
[45] Apr. 17, 1984

[54] METHOD FOR REDUCING CATALYST AGING IN THE PRODUCTION OF CATALYTICALLY HYDRODEWAXED PRODUCTS

[75] Inventors: David S. Shihabi, Pennington; John D. Lutner, Lawrenceville, both of N.J.

[73] Assignee: Mobil Oil Corporation, New York, N.Y.

[21] Appl. No.: 460,218

[22] Filed: Jan. 24, 1983

[51] Int. Cl.[3] ..... C10G 47/20; C10G 65/12

[52] U.S. Cl. ..... 208/97; 208/111; 208/109

[58] Field of Search ..... 208/97, 111, 120, 109

[56] References Cited

U.S. PATENT DOCUMENTS 2,425,482 8/1947 Moser ..... 208/120
3,542,668 11/1970 Van Pool ..... 208/67
3,954,600 5/1976 Gladrow et al. ..... 208/119
4,035,285 7/1977 Owen et al. ..... 208/120
4,124,650 11/1978 Olavesen et al. ..... 208/111 X
4,172,812 10/1979 Winter ..... 208/72
4,361,477 11/1982 Miller ..... 208/67
4,377,469 3/1983 Shihabi ..... 208/111

*Primary Examiner*—Delbert E. Gantz
*Assistant Examiner*—O. Chaudhuri
*Attorney, Agent, or Firm*—Alexander J. McKillop; Michael G. Gilman; Laurence P. Hobbes

[57] ABSTRACT

A method for stabilizing the activity of a highly siliceous zeolite used as a catalyst in the processing of hydrocarbon feedstock comprises the addition of about 0.1 to 10 weight percent olefins to the feedstock prior to contacting with said catalyst under hydrocarbon conversion conditions. The method is particularly useful when used in catalytic dewaxing processes.

17 Claims, 3 Drawing Figures

METHOD FOR REDUCING CATALYST AGING IN THE PRODUCTION OF CATALYTICALLY HYDRODEWAXED PRODUCTS

BACKGROUND OF THE INVENTION

1. Field of the Invention

This invention relates to a method for stabilizing the activity of catalysts used in the conversion of hydrocarbons. More particularly, it pertains to a method for reducing the aging rate of hydrodewaxing catalysts employed in either distillate dewaxing or lube dewaxing processes.

2. Description of Related Art

This invention is concerned with processes used to reduce wax content of hydrocarbon fractions by conversion of straight or slightly branched paraffin hydrocarbons. Such processes may utilize shape-selective dual function catalysts in the presence of hydrogen, a technique which is known as catalytic hydrodewaxing.

It is known in the art to add olefins to a hydrocarbon oil cracking process in order to produce products of improved quality. U.S. Pat. No. 3,758,400 to Hampton describes a method of cracking hydrocarbon oils in the presence of an aromatic concentrate containing olefinic hydrocarbons in order to produce gasolines of increased octane number. U.S. Pat. No. 3,954,600 to Gladrow et al. relates to a method for increasing yield and selectivity to middle distillate boiling range components in the catalytic cracking of a hydrocarbon feedstock by conducting said cracking in the presence of a normally liquid olefin-containing naphtha. U.S. Pat. No. 4,146,465 to Blazek, Sr. et al. relates to a process for increasing the octane rating of gasoline and decreasing the quantity of coke produced by a catalytic cracking process by adding $C_2$ to $C_6$ linear olefins to the gas oil feed. U.S. Pat. No. 4,181,597 to Yan et al. discloses a process for improving the stability of a hydrocracked mineral oil by reacting the oil with an olefin stabilizing agent in the presence of a heterogeneous acidic catalyst.

In addition to the above methods, it is also known in the art to utilize olefins in the alkylation of waxy hydrocarbons to normally liquid hydrocarbons. For example, U.S. Pat. No. 4,176,044 to White discloses a process for alkylating normally solid hydrocarbons to liquid hydrocarbons boiling primarily in the lube oil range, by contacting the wax and a low molecular weight olefin, such as ethylene, with a catalyst comprising one or more $C_3$–$C_5$ carbon atom secondary alcohols at elevated temperatures and pressure.

The prior art also describes certain methods for stabilizing the activity or controlling the aging of acidic crystalline zeolite catalysts used in hydrodewaxing. For example, U.S. Pat. No. 4,247,388 describes a method for controlling the aging of such catalysts by adjusting their initially high acid activity to lower levels by methods such as steaming or ion exchange.

SUMMARY OF THE INVENTION

It has now been discovered that the aging rate of a highly siliceous zeolite used as a catalyst in the processing of hydrocarbon feedstock can be reduced by adding olefins to said feedstock prior to its exposure to said catalyst under hydrocarbon conversion conditions, such as elevated temperatures. In particular, the method of the present invention has been found useful where applied to catalytic dewaxing or catalytic hydrodewaxing of hydrocarbon feedstocks. Catalysts which are exposed to olefin-containing hydrocarbon feeds according to the method of the present invention exhibit an enhanced stability which results in a significant reduction in aging.

DESCRIPTION OF SPECIFIC EMBODIMENTS

Figure 1:
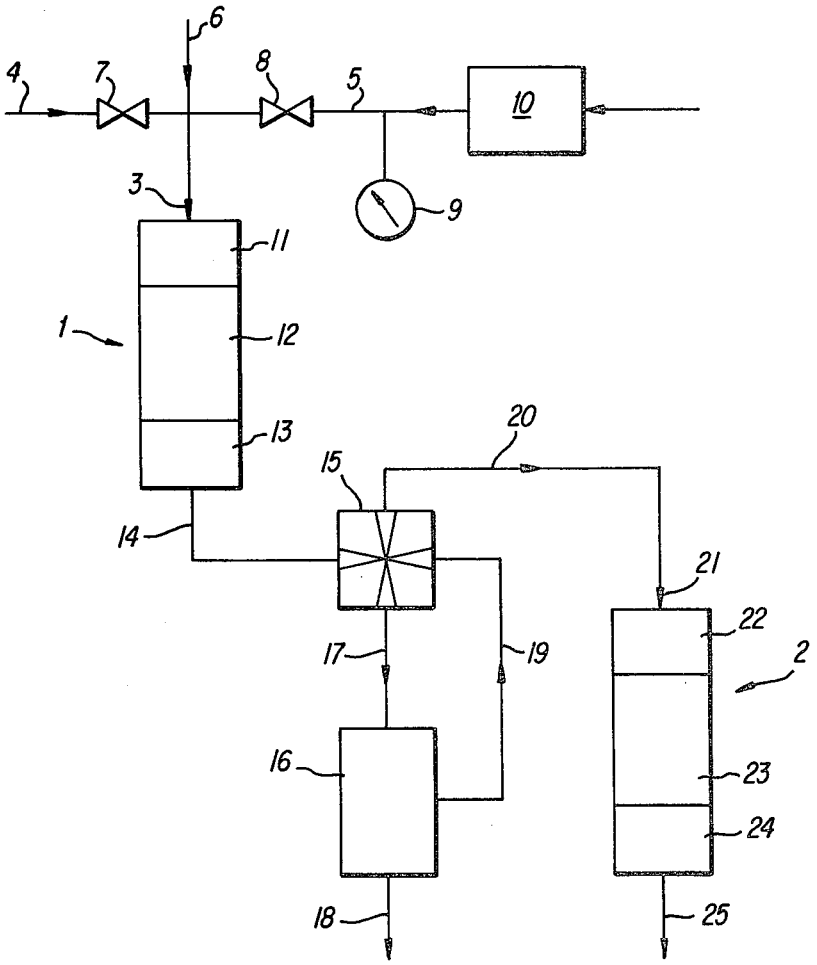
FIG. 1 represents a diagram of a two-stage hydrodewaxing/hydrotreating reactor system.

It has been discovered that the aging rates of highly siliceous zeolites used as catalysts in the catalytic conversion of a hydrocarbon feedstock, can be reduced by the addition of from about 0.1 to 10 weight percent olefins to the feedstock prior to its contact with the catalyst under hydrocarbon conversion conditions. Catalytic dewaxing and catalytic hydrodewaxing processes, in particular, are well-suited for use with the concepts of the present invention.

The olefins suited for use as additives to the hydrocarbon feed undergoing treatment include olefins having the bond group $$-\overset{|}{C}=\overset{|}{C}-$$

in which the dangling valences are attached to hydrogen, or alkyl, aryl, aralkyl, alkaryl or other alkenyl, said groups containing at least 2 carbon atoms, and preferably from 2 to about 30 carbon atoms. Such olefins as ethene, butene, hexene, decene, octadecene, butadiene, styrene, phenyl propylene, and other polymers, such as propylene tetramer, and the like are suitable. Preferably 1-olefins or 2-olefins are used. The olefin can also be a mixture of olefins, or a mixture of olefins and alkanes, such as propylene/propane or butene/butane, or any other convenient mixture, e.g., olefins in a reaction product mixture from a dehydrogenation reaction. The olefins may be added directly to the hydrocarbon feedstock or, alternatively, may be added in the form of an olefin-containing hydrocarbon mixture. In any event, the amount of olefin added to the feedstock ranges from about 0.1 to 10 weight percent of the resulting mixture, preferably between about 0.25 to 2 weight percent. The amount of olefin to be added may also be determined on a molar basis. Generally, about 0.02 to 2 moles, preferably about 0.02 to 0.4 moles of olefin per liter of hydrocarbon feedstock are added.

The catalyst employed in the hydrocarbon conversion of the present invention comprises a particular type of crystalline aluminosilicate zeolite material which exhibits unusual properties. Although such zeolites have unusually low alumina contacts, i.e. high silica to alumina mole ratios, they are very active even when the silica to alumina mole ratio exceeds 30. Such activity is surprising, because catalytic activity is generally attributed to framework aluminum atoms and/or cations associated with these aluminum atoms. These zeolites retain their crystallinity for long periods in spite of the presence of steam at high temperatures which induces irreversible collapse of the framework or other zeolites, e.g. of the X and A type. Furthermore, carbonaceous deposits, when formed, may be removed by burning at higher than usual temperatures to restore activity. These zeolites, used as catalysts, generally have low coke-forming activity and therefore are conducive to long times on stream between regenerations by burning carbonaceous deposits with oxygen-containing gas such as air.

An important characteristic of the crystal structure of this particular class of zeolites is that it provides a selective constrained access to and egress from the intracrystalline free space by virtue of having an effective pore size intermediate between the small pore Linde A and the large pore Linde X, i.e., the pore windows of the structure are of about a size such as would be provided by 10-membered rings of silicon atoms interconnected by oxygen atoms. It is to be understood, of course, that these rings are those formed by the regular disposition of the tetrahedra making up the anionic framework of the crystalline zeolite, the oxygen atoms themselves being bonded to the silicon or aluminum atoms at the centers of the tetrahedra. Briefly, the preferred type zeolites useful in this invention possess, in combination: a silica to alumina mole ratio of at least about 12; and a structure providing constrained access to the intracrystalline free space.

The silica to alumina mole ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina mole ratio of at least 12 are useful, it is preferred in some instances to use zeolites having substantially higher silica/alumina ratios, e.g., 70 and above or even 1600 and above. In addition, zeolites as otherwise characterized herein but which are substantially free of aluminum, that is zeolites having silica to alumina mole ratios of up to infinity, are found to be useful and even preferable in some instances. Such "high silica" or "highly siliceous" zeolites are intended to be included within this description.

Members of this particular class of zeolites, after activation, acquire an intracrystalline sorption capacity for normal hexane which is greater than that for water, i.e. they exhibit "hydrophobic" properties. This hydrophobic character can be used to advantage in some applications.

The zeolites of the particular class useful herein having an effective pore size such as to freely sorb normal hexane. In addition, their structure must provide constrained access to larger molecules. It is sometimes possible to judge from a known crystal structure whether such constrained access exists. For example, if the only pore windows in a crystal are formed by 8-membered rings of silicon and aluminum atoms, then access by molecules of larger cross-section than normal hexane is excluded and the zeolite is not of the desired type. Windows of 10-membered rings are preferred, although in some instances excessive puckering of the rings or pore blockage may render these zeolites ineffective. Twelve-membered rings usually do not offer sufficient constraint to produce the advantageous conversions, although the puckered 12-ring structure of TMA offretite shows constrained access. Other 12-ring structures may exist which may be operative.

Rather than attempt to judge from crystal structure whether or not a zeolite possesses the necessary constrained access to molecules of larger cross-section than normal paraffins, a simple determination of the "Constraint Index" as herein defined may be made by passing continuously a mixture of an equal weight of normal hexane and 3-methylpentane over a sample of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 540° C. for at least 15 minutes. The zeolite is then flushed with helium and the temperature is adjusted between 290° C. and 510° C. to give an overall conversion of between 10% and 60%. The mixture of hydrocarbons is passed at 1 liquid hourly space velocity (i.e., 1 volume of liquid hydrocarbon per volume of zeolite per hour) over the zeolite with a helium dilution to give a helium to (total) hydrocarbon mole ratio of 4:1. After 20 minutes on stream, a sample of the effluent is taken and analyzed, most conveniently by gas chromatography, to determine the fraction remaining unchanged for each of the two hydrocarbons.

The "Constraint Index" is calculated as follows:

$$\text{Constraint Index} = \frac{\log_{10}(\text{fraction of hexane remaining})}{\log_{10}(\text{fraction of 3-methylpentane remaining})}$$

The Constraint Index approximates the ratio of the cracking rate constants for the two hydrocarbons. Zeolites suitable for the present invention are those having a Constraint Index of about 1 to 12. Constraint Index (CI) values for some typical materials are:

| Zeolite | C.I. |
|---|---|
| ZSM-5 | 8.3 |
| ZSM-11 | 8.7 |
| ZSM-12 | 2 |
| ZSM-23 | 9.1 |
| ZSM-35 | 4.5 |
| ZSM-38 | 2 |
| ZSM-48 | 3.4 |
| TMA Offretite | 3.7 |
| Clinoptilolite | 3.4 |
| Beta | 1.5 |
| H-Zeolon (mordenite) | 0.4 |
| REY | 0.4 |
| Amorphous Silica-Alumina | 0.6 |
| Erionite | 38 |

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby exhibit different Constraint Indices. Constraint Index seems to vary somewhat with severity of operation (conversion) and the presence or absence of binders. Likewise, other variables such as crystal size of the zeolite, the presence of occluded contaminants, etc., may affect the Constraint Index. Therefore, it will be appreciated that it may be possible to so select test conditions as to establish more than one value in the range of 1 to 12 for the Constraint Index of a particular zeolite. Such a zeolite exhibits the constrained access as herein defined and is to be regarded as having a Constraint Index in the range of 1 to 12. Also contemplated herein as having a Constraint Index in the range of 1 to 12 and therefore within the scope of the defined class of highly siliceous zeolites are those zeolites which, when tested under two or more sets of conditions within the above-specified ranges of temperature and conversion, produce a value of the Constraint Index slightly less than 1, e.g. 0.9, or somewhat greater than 12, e.g. 14 or 15, with at least one other value within the range of 1 to 12. Thus, it should be understood that the Constraint Index value as used herein is an inclusive rather than an exclusive value. That is, a crystalline zeolite when identified by any combination of conditions within the testing definition set forth herein as having a Constraint Index in the range of 1 to 12 is intended to be included in the instant novel zeolite definition whether or not the same identical zeolite, when tested under other of the defined conditions, may give a Constraint Index value outside of the range of 1 to 12.

The particular class of zeolites defined herein is exemplified by ZSM-5, ZSM-5/ZSM-11 intermediates, ZSM-11, ZSM-12, ZSM-23, ZSM-35, ZSM-38, ZSM-48 and other similar materials.

ZSM-5 is described in greater detail in U.S. Pat. Nos. 3,702,886 and Re. 29,948. The entire descriptions contained within those patents, particularly the X-ray diffraction pattern of therein disclosed ZSM-5, are incorporated herein by reference.

ZSM-5/ZSM-11 intermediate compositions are described in U.S. Pat. No. 4,229,424. That description, and in particular the X-ray diffraction pattern of said compositions disclosed therein, is incorporated herein by reference.

ZSM-11 is described in U.S. Pat. No. 3,709,979. That description, and in particular the X-ray diffraction pattern of said ZSM-11, is incorporated herein by reference.

ZSM-12 is described in U.S. Pat. No. 3,832,449. That description, and in particular the X-ray diffraction pattern disclosed therein, is incorporated herein by reference.

ZSM-23 is described in U.S. Pat. No. 4,076,842. The entire content thereof, particularly the specification of the X-ray diffraction pattern of the disclosed zeolite, is incorporated herein by reference.

ZSM-35 is described in U.S. Pat. No. 4,016,245. The description of that zeolite, and particularly the X-ray diffraction pattern thereof, is incorporated herein by reference.

ZSM-38 is more particularly described in U.S. Pat. No. 4,046,859. The description of that zeolite, and particularly the specified X-ray diffraction pattern thereof, is incorporated herein by reference.

ZSM-48 is more particularly described in U.S. Pat. No. 4,375,573, the entire content of which is incorporated herein by reference.

It is to be understood that by incorporating by reference the foregoing patent documents to describe examples of specific members of the specified zeolite class with greater particularity, it is intended that identification of the therein disclosed crystalline zeolites be resolved on the basis of their respective X-ray diffraction patterns. As discussed above, the present invention contemplates utilization of such catalysts wherein the mole ratio of silica to alumina is essentially unbounded. The incorporation of the identified patents should therefore not be construed as limiting the disclosed crystalline zeolites to those having the specific silica-alumina mole ratios discussed therein, it now being known that such zeolites may be substantially aluminum-free and yet, having the same crystal structure as the disclosed materials, may be useful or even preferred in some applications. It is the crystal structure, as identified by the X-ray diffraction "fingerprint", which establishes the identity of the specific crystalline zeolite material.

The specific zeolites described, when prepared in the presence of organic cations, are substantially catalytically inactive, possibly because the intra-crystalline free space is occupied by organic cations from the forming solution. They may be activated by heating in an inert atmosphere at 540° C. for one hour, for example, followed by base exchange with ammonium salts followed by calcination at 540° C. in air. The presence of organic cations in the forming solution may not be absolutely essential to the formation of this type zeolite; however, the presence of these cations does appear to favor the formation of this special class of zeolite. More generally, it is desirable to activate this type catalyst by base exchange with ammonium salts followed by calcination in air at about 540° C. for from about 15 minutes to about 24 hours.

Natural zeolites may sometimes be converted to zeolite structures of the class herein identified by various activation procedures and other treatments such as base exchange, steaming, alumina extraction and calcination, alone or in combinations. Natural minerals which may be so treated include ferrierite, brewsterite, stilbite, dachiardite, epistilbite, heulandite, and clinoptilolite.

The preferred crystalline zeolites for utilization herein include ZSM-5, ZSM-5/ZSM-11 intermediates, ZSM-11, ZSM-12, ZSM-23, ZSM-35, ZSM-38 and ZSM-48, with ZSM-5 being particularly preferred.

In a preferred aspect of this invention, the zeolites hereof are selected as those providing among other things a crystal framework density, in the dry hydrogen form, of not less than about 1.6 grams per cubic centimeter. It has been found that zeolites which satisfy all three of the discussed criteria are most desired.

Therefore, the preferred zeolites useful with respect to this invention are those having a Constraint Index as defined above of about 1 to about 12, a silica to alumina mole ratio of at least about 12 and a dried crystal density of not less than about 1.6 grams per cubic centimeter. The dry density for known structures may be calculated from the number of silicon plus aluminum atoms per 1000 cubic Angstroms, as given, e.g., on Page 19 of the article Zeolite Structure by W. M. Meier. This paper, the entire contents of which are incorporated herein by reference, is included in Proceedings of the Conference on Molecular Sieves, (London, April 1967) published by the Society of Chemical Industry, London, 1968.

When the crystal structure is unknown, the crystal framework density may be determined by classical pycnometer techniques. For example, it may be determined by immersing the dry hydrogen form of the zeolite in an organic solvent which is not sorbed by the crystal. Or, the crystal density may be determined by mercury porosimetry, since mercury will fill the interstices between crystals but will not penetrate the intracrystalline free space.

It is possible that the unusual sustained activity and stability of this special class of zeolites is associated with its high crystal anionic framework density of not less than about 1.6 grams per cubic centimeter. This high density must necessarily be associated with a relatively small amount of free space within the crystal, which might be expected to result in more stable structures. This free space, however, is important as the locus of catalytic activity.

Crystal framework densities of some typical zeolites, including some which are not within the purview of this invention, are:

| | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| ZSM-12 | — | 1.8 |
| ZSM-23 | — | 2.0 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

When synthesized in the alkali metal form, the zeolite is conveniently converted to the hydrogen form, generally by intermediate formation of the ammonium form as a result of ammonium ion exchange and calcination of the ammonium form to yield the hydrogen form. In addition to the hydrogen form, other forms of the zeolite wherein the alkali metal has been reduced to less than about 50 percent by weight of the original alkali metal contained in the zeolite as-synthesized, usually 0.5 percent by weight or less, may be used as precursors to the alkaline-earth metal modified zeolites of the present invention. Thus, the original alkali metal of the zeolite may be replaced by ion exchange with other suitable metal cations of Groups I through VIII of the Periodic Table, including, by way of example, nickel, copper, zinc, palladium, calcium or rare earth metals.

In practicing conversion processes of the present invention, it may be useful to incorporate the above-described crystalline zeolites with a matrix comprising another material resistant to the temperature and other conditions employed in such processes. Such matrix materials include synthetic or naturally occurring substances as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the zeolites employed herein may be composited with a porous matrix material, such as silica, alumina, silica-alumina, silica-magnesia, silica-zirconia, silica-thoria, silica-beryllia, and silica-titania, as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix, on an anhydrous basis, may vary widely with the zeolite content ranging from between about 1 to about 99 percent by weight and more usually in the range of about 5 to about 80 percent by weight of the dry composite.

Although the method of the present invention is suited for use in conjunction with any hydrocarbon conversion, it has been found to be of particular value where employed in catalytic dewaxing processes. As is disclosed in U.S. Pat. No. Re. 28,293, incorporated herein by reference, catalytic dewaxing may be accomplished either by selectively cracking the waxy constituents in the feed or by hydrocracking these constituents. The hydrodewaxing process is particularly suited for use with the method of the present invention. The term "hydrodewaxing" as used in the specification and claims is used in its broadest sense and is intended to mean the removal of those hydrocarbons which readily solidify (waxes) from hydrocarbon stocks. Hydrocarbon feeds which can be treated include lubricating oil stocks as well as those which have a freeze point or pour point problem, i.e. stocks boiling above about 350° F. such as whole crude, distillates, bright stock, etc. In this embodiment, the feed is catalytically hydrodewaxed in the presence of hydrogen and a highly siliceous zeolite dewaxing catalyst such as those described above. In addition, the dewaxing zeolite catalysts can be used in intimate combination with a hydrogenating component such as tungsten, vanadium, molybdenum, rhenium, nickel, cobalt, chromium, manganese, or a noble metal such as platinum or palladium. Such component can be exchanged into the composition, impregnated therein or physically intimately admixed therewith. Such component can be impregnated in or onto zeolite such as, for example, by, in the case of platinum, treating the zeolite with a platinum metal-containing ion. Thus, suitable platinum compounds include chloroplatinic acid, platinous chloride and various compounds containing the platinum amine complex.

The compounds of the useful platinum or other metals can be divided into compounds in which the metal is present in the cation of the compound and compounds in which it is present in the anion of the compound. Both types of compounds which contain the metal in the ionic state can be used. A solution in which platinum metal is in the form of a cation or cationic complex, e.g., $Pt(NH_3)_4Cl_2$ is particularly useful. It is to be understood that the presence of a hydrogenating component is not required and is optional.

Preferably, the hydrodewaxing zeolite catalysts employed herein have alpha values ranging from about 10 to 300, preferably about 30 to 150. Alpha value or alpha activity is a measure of normal hexane cracking conversion relative to a silica-alumina cracking catalyst and the alpha test is described in a Letter to the Editor entitled "Superactive Crystalline Aluminosilicate Hydrocabon Cracking Catalyst" by P. B. Weisz and J. N. Miale, Journal of Catalysis, Vol. 4, No. 4, August, 1965, pages 527–529, said article being herein incorporated by reference.

Control of the alpha value can be achieved by reducing the initially high alpha activity down to the desired range by a wide variety of techniques. In this connection, it is known in the art that the alpha activity of a zeolite can be reduced by providing basic cations such as sodium in order to replace a portion of the cationic sites of the zeolites. Techniques of this type are described in U.S. Pat. No. 3,899,544 the disclosure of which is incorporated by reference. Thus, by way of specific illustration, if an acidic ZSM-5 zeolite had an initial alpha value in excess of 150, e.g., 177, a portion of its cationic sites could be replaced by sodium ions until its alpha activity was within the desired range.

Still another method of reducing the alpha activity is by partial coking of the catalyst. As is known in the art, when acidic zeolites are utilized for various hydrocarbon conversion processes, a material deposits on the catalyst which is commonly referred to as coke. This material has a tendency to deactivate the zeolite and, as such, partial coking is an effective way of reducing the initially high alpha activity of the zeolite down to the desired levels.

The preferred method for reducing the initially high activity of the zeolites with which this invention is concerned is by steaming.

Preferably, steaming is carried out at elevated temperatures ranging from 300° F.–1500° F. at either atmospheric or elevated pressures. The steaming can be carried out in atmospheres of 100% steam or an atmosphere of steam and an inert gas.

If the catalyst is to be steamed in situ, it is expedient to use mixtures of steam and hydrogen at pressures from 50–200 psig and temperatures from 700°–900° F. for periods of time ranging from 1–48 hours. The exact reduction in alpha activity is a function of steam partial pressure, temperature and time. None of these variables is critical per se and the only requirement is that the steaming be carried out in order to obtain the desired range of alpha values.

For a nickel-exchanged acid ZSM-5 (NiH/ZSM-5), steaming with a 50/50 mixture by volume of steam and hydrogen at 100 psig and 800° F. for 12–24 hours is satisfactory.

Following the treatment with steam, the nickel exchanged acidic ZSM-5 type zeolite is preferably sulfided by treatment with a sulfiding compound such as hydrogen sulfide at elevated temperatures of about 450°–650° F.

Prior to use, the zeolites should be dehydrated at least partially. This can be done by heating to a temperature in the range of 200° to 600° C. in an atmosphere, such as air, nitrogen, etc. and at atmospheric or subatmospheric pressures for between 1 to 48 hours. Dehydration can also be performed at lower temperatures merely by using a vacuum, but a longer time is required to obtain a sufficient amount of dehydration.

The dewaxing process is carried out in the presence of hydrogen and olefins at temperatures ranging from about 260° C. to 427° C. (500° to 800° F.), preferably about 270° to 371° C. (520° to 700° F.), pressures between about 50 and 4000 psig, preferably about 200 and 2000 psig. The liquid hourly space velocity is generally between about 0.1 and 5, preferably between about 0.3 and 3, and the hydrogen circulation rate is about 500–100,000 standard cubic feet of hydrogen per barrel of feed (s.c.f.b.).

In one embodiment of the present invention, the hydrocarbon feedstock may also be hydrotreated as well as catalytically hydrodewaxed in order to remove impurities such as nitrogen and sulfur compounds.

Any conventional hydrotreating catalyst and process may be used which serve effectively to reduce the nitrogen and sulfur levels. The hydrotreating catalyst comprises a hydrogenation component on a non-acidic support, such as cobalt-molybdate or nickel-molybdate on alumina. The hydrotreater operates at about 218°–399° C. (425°–750° F.), preferably about 246°–371° C. (475°–700° F.), and a space velocity like that of the catalyst dewaxing reactor. The reactions are carried out at hydrogen partial pressures of 150–1500 psig, at the reactor inlets, and preferably at 750–1250 psig, with 1000 to 10,000 s.c.f.b., preferably 2500 to 5000 s.c.f.b.

As is evident to one skilled in the art, the steps of catalytic dewaxing and hydrotreating may be conducted without interstage separation of light products, i.e., in cascade fashion. The conditions for the individual process steps may be coupled, e.g., substantially the same pressure may be used in both steps, or each step may be independently optimized. All of these modes of operation are contemplated as within the scope of the present invention, the choice in each particular instance depending on the nature of the feed and the desired results including by-product type and composition. Uncoupled operation does, of course, provide the most flexible operation. In all cases, however, the product formed in the hydroconversion step will require separation and recovery of the +343° C. (+650° F.) lube base stock from light products. Such separation is accomplished by methods well-known to those skilled in the art.

In a preferred embodiment of the present invention, the catalytic dewaxing and hydrotreating processes of the present invention are carried out in a two-stage reactor system such as that depicted in FIG. 1. The reactor system comprises a hydrodewaxing downflow trickle bed reactor 1 and a separate hydrotreating downflow trickle bed reactor 2.

At the top of the hydrodewaxing reactor is a manifold communicating with the interior of said reactor 3, into which a hydrocarbon feed inlet 4, an olefin feed inlet 5 and a hydrogen inlet 6 pass, the hydrocarbon feed and the olefin feed inlet being controlled by check valves 7 and 8, respectively, which permit regulation of the proportions of the intake mixture.

A pressure gauge 9 is located between check valve 8 and olefin feed pump 10 to monitor the rate at which olefins are introduced to the reaction mixture, as well as pump leakage. The reaction mixture of hydrocarbon feed, olefin and hydrogen enters the hydrodewaxing reactor through manifold 3 and passes through a preheat section 11 filled with 14/20 mesh Vycor®. The heated reaction mixture thence passes to a hydrodewaxing catalyst section 12 containing a suitable hydrodewaxing catalyst, diluted with an equal volume of 14/20 mesh Vycor® to prevent channeling of the reaction mixture as it descends through the catalyst. The exit section 13 is also filled with 14/20 mesh Vycor®. The products of the hydrodewaxing stage pass through outlet 14 to a sampling valve 15 through which said products can be routed to an interstage sampler 16 via line 17 for assay. The first stage product may be either collected through line 18 or returned to the sampling valve through line 19 for transmission to the second stage 2. The products directly from the first stage 1, as well as those returned from the interstage sampler 16, are transmitted to the second stage 2 via line 20 which passes to the hydrotreater inlet 21 to hydrotreater pre-heat section 22 which is packed with 14/20 mesh Vycor®. Beneath the pre-heat section lies the hydrotreater section 23 which contains a suitable hydrotreating catalyst diluted with an equal volume of 14/20 mesh Vycor®. After contact with the hydrotreating catalyst the dewaxed hydrotreated product passes through a 14/20 mesh Vycor®-packed exit section 24 and thence through the hydrotreater outlet 25 where it is collected. Prior to introduction of the hydrocarbon feed to the reactor system the catalyst train is purged at room temperature with hydrogen at pressures of 1 atm and higher. The system is then gradually raised to an intermediate temperature of about 200° to 300° C. (392° to 572° F.) and held for several hours. The catalysts of both reactors can then be pre-sulfided by passing a mixture of about 2.1% $H_2S$ in $H_2$ through the system. The system is then elevated to operating temperatures between about 280° and 310° C. (540° and 590° F.) for the hydrotreating reactor. At this point, the hydrocarbon feed may be introduced into the reactor system.

In order to more fully illustrate the nature of the invention without limiting the same, the following examples are provided.

EXAMPLE 1

An Adelaide Bright Stock raffinate feed was treated in the two-stage reactor system shown in FIG. 1 and described above. The first reactor contained 15 cc of a NiHZSM-5 extrudate, the distillate dewaxing catalyst described in Table 1, said catalyst being combined with an equal volume of 14/20 mesh Vycor®. The catalyst train was purged with hydrogen at 1 atm and room temperature. Reactor temperatures were than raised 27.8° C. (50° F.) every 15 minutes to 232° C. (450° F.) and held for four hours. Presulfiding was then carried out in flowing 2.1% $H_2S$ in $H_2$ (50 cc/minute) at atmospheric pressure and 232° C. ( 450° F.) for 15 hours. Following presulfiding the unit was pressurized with $H_2$ to 400 psig and hydrogen flow rate was adjusted to about 75 cc/minute. Temperatures of the dewaxing and hydrofinishing reactors were raised to 293° C. (560° F.) and 287° C. (550° F.) respectively. At these conditions oil was pumped into the unit at a rate of 10 ml/hour. Start of cycle conditions can be summarized as follows:

| | Hydrodewaxing Stage | Hydrotreating Stage |
|---|---|---|
| Reactor Temperature, °F. | 560 | 550 |
| LHSV | 0.67 | 0.8 |
| Pressure, psig | 400 | 400 |
| Hydrogen Circulation (SCF/BBL) | 2500 | 2500 |

Figure 2:
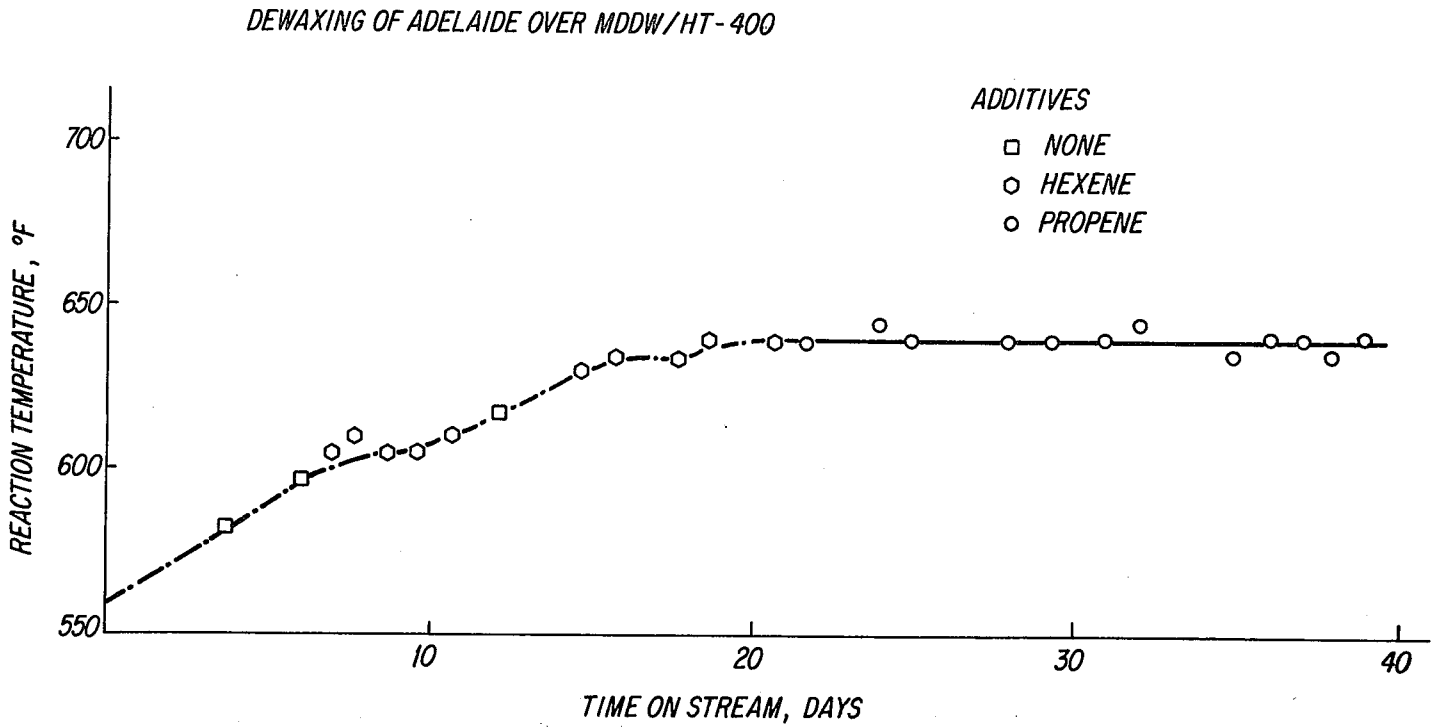
FIG. 2 represents a graph which shows the effect of olefin cofeeding on the aging rate of a NiHZSM-5 extrudate used in dewaxing Bright Stock raffinate.

A continuous run lasting about 39 days was made. Based on the results shown in FIG. 2 and Table 2, the initial aging rate was estimated to be approximately 2.8° C. (5° F.)/day. After 6 days on stream, 1-hexene was cofed at 0.5 wt.% of the hydrocarbon feedstock. From the 11th day to the 14th day on stream, hexene cofeeding was stopped. On the 14th day a mixture of 1-hexene and n-hexane as diluent was cofed as indicated in Table 2. Data indicate that 1-hexene cofeeding reduced catalyst aging from 2.8° C. (5° F.)/day to 0.6° to 1.1° C. (1°-2° F.)/day. On the 21st day on-stream, the paraffin-/olefin mixture was replaced with propene. For the first 24 hours, liquid propene was cofed at a rate of 0.5 wt.%; thereafter, propene cofeed was reduced to 0.25 wt.% based on the Adelaide raffinate hydrocarbon feedstock. In order to produce a −6.7° C. (20° F.) pour point 399° C.+ (750° F.+) product, the reactor temperature was reduced from 343° to 340° C. (650° F. to 645° F.) on the 30th day on stream, and subsequently to 338° C. (640° F.) on the 35th day. The catalyst aging data are plotted in FIG. 2. These data show that continuous propene cofeeding reduced catalyst aging to less than 0.5° C. (0.9° F.)/day.

EXAMPLE 2

Figure 3:
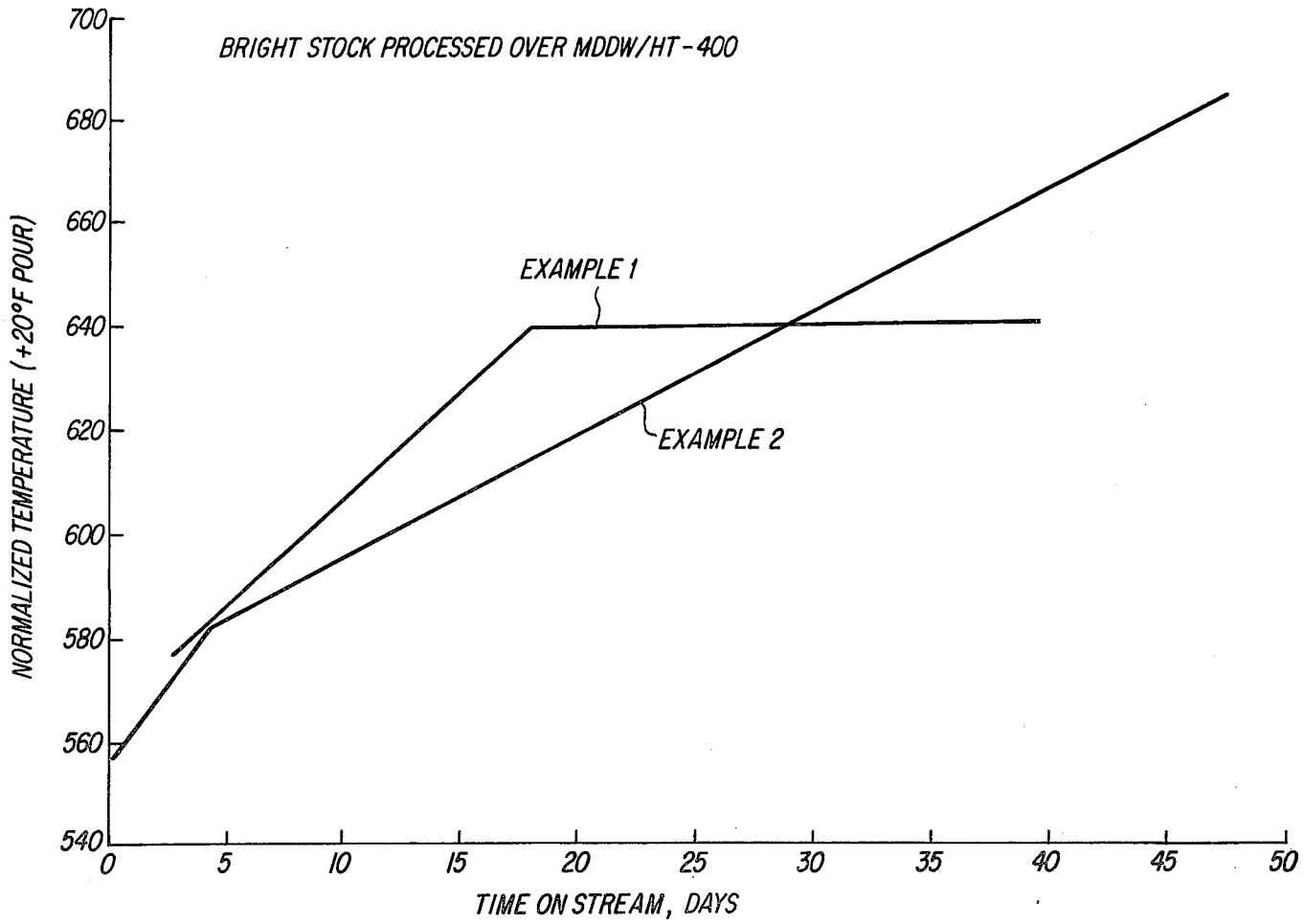
FIG. 3 represents a graph comparing the aging rate of the fresh catalyst of Example 1 with the hydrogen activated catalyst of Example 2.

The catalyst from the above experiment was hydrogen reactivated by turning the hydrocarbon feed off and raising the dewaxing reactor temperature at a rate of 27.8° C. (50° F.) every 15 minutes to 482° C. (900° F.) and holding for 24 hours. The temperature of the hydrotreating reactor was maintained at 100° C. (212° F.) throughout the hydrogen activation procedure. Following hydrogen activation the dewaxing reactor temperature was lowered to 293° C. (560° F.) and the hydrotreating reactor temperature was increased to the same temperature. Bright stock feed was introduced into the reactor system at the same conditions as in Example 1 and a continuous run dewaxing bright stock lasting about 49 days was made. Based on the results shown in FIG. 3 and Table 3, the initial aging rate was estimated to be approximately 2.8° C. (5° F.)/day. The data show that continuous propene cofeeding reduced catalyst aging.

TABLE 1

Physical Properties of the Nickel/HZSM-5 Catalyst Extrudate Used in Dewaxing Adelaide Bright Stock Raffinate with Propene Cofeed

| | Catalyst ID (NiHZSM-5 xtr.) |
|---|---|
| Analytical Results: | |
| Alpha Activity | 101 |
| Crystallinity, % | 55 |
| Density, g/cc | |
| Real | 2.49 |
| Particle | 0.80 |
| Packed | 0.58 |
| Surface Area $m^2/g$ | 350 |
| Pore Volume, cc/g | 0.714 |
| Avg. Pore Diameter, A | 82 |
| Pore Volume Distribution | |
| PV % in Pores of | |
| 0–30 A Diameter | 23 |
| 30–50 | 10 |
| 50–80 | 11 |
| 80–100 | 7 |
| 100–150 | 13 |
| 150–200 | 6 |
| 200–300 | 5 |
| 300+ | 25 |
| Crush Strength, lb/inch | 70 |
| Ni, wt % | 1.1 |
| Na, wt % | 0.02 |

TABLE 2

ADELAIDE BRIGHT STOCK PROCESSED OVER DEWAXING CATALYST

| Reading No. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| n-Hexane (% wt) | — | — | — | — | — | — | — | — | — | — | — | — | 0.7 | 0.7 | 0.7 | 1.0 |

TABLE 2-continued

ADELAIDE BRIGHT STOCK PROCESSED OVER DEWAXING CATALYST

| | | | | | | | | | | | | | | | | |
|---|---|---|---|---|---|---|---|---|---|---|---|---|---|---|---|---|
| 1-Hexane % wt. | — | — | — | — | — | 0.5 | 0.5 | 0.5 | 0.5 | 0.5 | 0.5 | — | 0.3 | 0.3 | 0.3 | 0.5 |
| Propene % wt. | — | — | — | — | — | — | — | — | — | — | — | — | — | — | — | — |
| TEMP. °F. | | | | | | | | | | | | | | | | |
| (MDDW) | 560 | 580 | 595 | 610 | 620 | 630 | 630 | 630 | 630 | 630 | 630 | 630 | 630 | 635 | 635 | 635 |
| (HDT) | 550 | 560 | 560 | 560 | 560 | 560 | 560 | 560 | 560 | 480 | 570 | 570 | 570 | 570 | 570 | 570 |
| LHSV | | | | | | | | | | | | | | | | |
| (MDDW) | 0.71 | 0.67 | 0.69 | 0.67 | 0.70 | (1) | 0.67 | 0.72 | 0.70 | 0.70 | 0.69 | 0.69 | 0.65 | 0.60 | 0.60 | 0.66 |
| (HDT) | 0.86 | 0.80 | 0.83 | 0.81 | 0.84 | (1) | 0.80 | 0.86 | 0.84 | 0.84 | 0.82 | 0.82 | 0.78 | 0.72 | 0.72 | 0.80 |
| Time On-Stream(Days) | 1.8 | 2.8 | 3.8 | 4.8 | 6.0 | 6.3 | 7.0 | 7.9 | 8.9 | 9.9 | 10.9 | 13.9 | 14.9 | 15.9 | 16.9 | 17.9 |
| PROD. WT. % | | | | | | | | | | | | | | | | |
| METHANE | .04 | .05 | .06 | .07 | .07 | — | .08 | .06 | .08 | .06 | .06 | .05 | .04 | .05 | .04 | .04 |
| ETHANE | .13 | .15 | .16 | .20 | .20 | — | .23 | .19 | .25 | .19 | .17 | .15 | .11 | .15 | .14 | .12 |
| ETHANE | — | — | — | — | — | — | — | — | — | — | — | — | — | — | — | — |
| PROPANE | 3.22 | 3.20 | 3.12 | 3.67 | 3.33 | — | 3.61 | 3.08 | 4.18 | 3.18 | 2.86 | 2.43 | 1.71 | 2.31 | 2.17 | 1.95 |
| PROPENE | — | — | — | — | — | — | — | — | — | — | — | — | — | — | — | — |
| ISOBUTANE | 1.93 | 1.75 | 1.65 | 1.87 | 1.67 | — | 2.00 | 1.67 | 2.51 | 1.96 | 1.82 | 1.58 | 1.11 | 1.57 | 1.52 | 1.41 |
| n-BUTANE | 2.02 | 1.63 | 1.44 | 1.57 | 1.35 | — | 1.62 | 1.35 | 2.09 | 1.63 | 1.48 | 1.28 | .89 | 1.28 | 1.23 | 1.20 |
| l-BUTENE | — | — | — | — | — | — | — | — | — | — | — | — | — | — | — | — |
| ISOBUTENE | — | — | — | — | — | — | — | — | — | — | — | — | — | — | — | — |
| T-2-BUTENE | — | — | — | — | — | — | — | — | — | — | — | — | — | — | — | — |
| C-2-BUTENE | — | — | — | — | — | — | — | — | — | — | — | — | — | — | — | — |
| TOTAL C4- | 7.3 | 6.8 | 6.4 | 7.4 | 6.6 | — | 7.5 | 6.4 | 9.1 | 7.0 | 6.4 | 5.5 | 3.9 | 5.4 | 5.1 | 4.7 |
| C5-750 F. | 3.9 | 2.7 | 2.4 | 2.5 | 2.6 | — | 3.1 | 2.0 | 4.3 | 3.6 | 2.9 | 2.2 | 2.1 | 2.9 | 2.7 | 3.3 |
| 750 F.+ | 88.8 | 90.5 | 91.2 | 90.1 | 90.8 | — | 89.4 | 91.6 | 86.6 | 89.4 | 90.7 | 92.3 | 94.0 | 91.7 | 92.2 | 92.0 |
| 750 F.+ CONV. | 11.2 | 9.5 | 8.8 | 9.9 | 9.2 | — | 9.9 | 7.9 | 12.9 | 10.1 | 8.8 | 7.2 | 5.0 | 7.8 | 6.8 | 6.5 |
| 750 F.+ POUR POINT F. | | | 5 | | −5 | | −5 | 0 | −5 | −5 | 0 | 30 | 20** | 15 | 15** | 15** |
| V.I. | | | 92 | | | | 95 | | 91 | | 93 | 93 | | 92 | 93 | |

| Reading No. | 17 | 18 | 19 | 20 | 21 | 22 | 23 | 24 | 25 | 26 | 27 | 28 | 29 | 30 | 31 | 32 |
|---|---|---|---|---|---|---|---|---|---|---|---|---|---|---|---|---|
| n-Hexane(% wt) | 1.0 | 0.7 | 0.0 | 0.0 | — | — | — | — | — | — | — | — | — | — | — | — |
| 1-Hexane % wt. | 0.5 | 0.3 | 0.0 | 0.0 | — | — | — | — | — | — | — | — | — | — | — | — |
| Propene % wt. | — | — | 0.5 | 0.25 | .25 | .25 | .25 | .25 | .25 | .25 | .25 | .25 | .25 | .25 | .25 | .25 |
| TEMP. F | | | | | | | | | | | | | | | | |
| (MDDW) | 640 | 645 | 645 | 645 | 650 | 650 | 650 | 650 | 645 | 645 | 645 | 640 | 640 | 640 | 640 | 640 |
| (HDT) | 455(2) | 570 | 570 | 570 | 570 | 570 | 570 | 570 | 570 | 570 | 570 | 570 | 570 | 570 | 570 | 570 |
| LHSV | | | | | | | | | | | | | | | | |
| (MDDW) | 0.66 | 0.62 | 0.67 | 0.67 | 0.68 | 0.67 | 0.62 | 0.66 | 0.65 | 0.66 | 0.68 | 0.60 | 0.63 | 0.64 | 0.64 | 0.63 |
| (HDT) | 0.79 | 0.74 | 0.80 | 0.81 | 0.82 | 0.80 | 0.74 | 0.79 | 0.78 | 0.79 | 0.82 | 0.72 | 0.75 | 0.77 | 0.77 | 0.75 |
| Time On-Stream(Days) | 18.8 | 20.9 | 21.9 | 22.9 | 24 | 25 | 28 | 29 | 30 | 31 | 32 | 35 | 36 | 37 | 38 | 39 |
| PROD. WT. % | | | | | | | | | | | | | | | | |
| METHANE | .03 | .05 | .04 | .07 | .06 | .05 | .06 | .05 | .05 | .04 | .04 | .04 | .04 | .04 | .03 | .03 |
| ETHANE | .05 | .16 | .14 | .25 | .24 | .22 | .24 | .21 | .21 | .18 | .17 | .16 | .16 | .16 | .15 | .12 |
| ETHANE | .02 | — | — | — | — | — | — | — | — | — | — | — | — | — | — | — |
| PROPANE | 2.17 | 2.21 | 2.14 | 3.62 | 3.32 | 2.89 | 3.09 | 2.85 | 3.02 | 2.53 | 2.43 | 2.29 | 2.27 | 2.20 | 2.02 | 1.68 |
| PROPENE | .38 | — | — | — | — | — | — | — | — | — | — | — | .01 | .01 | .01 | .01 |
| ISOBUTANE | 1.28 | 1.72 | 1.64 | 2.72 | 2.52 | 2.24 | 2.44 | 2.20 | 2.40 | 2.06 | 1.94 | 1.93 | 1.90 | 1.87 | 1.72 | 1.43 |
| n-BUTANE | 2.66 | 1.41 | 1.30 | 2.22 | 2.04 | 1.81 | 1.96 | 1.79 | 1.97 | 1.70 | 1.59 | 1.60 | 1.58 | 1.54 | 1.43 | 1.18 |
| 1-BUTENE | .16 | — | — | — | — | — | — | — | — | — | — | — | — | — | — | — |
| ISOBUTENE | — | — | — | — | — | — | — | — | — | — | — | — | — | — | — | — |
| T-2-BUTENE | .47 | — | — | — | — | — | — | — | — | — | — | — | — | — | — | — |
| C-2-BUTENE | .29 | — | — | — | — | — | — | — | — | — | — | — | — | — | — | — |
| TOTAL C4- | 7.5 | 5.5 | 5.3 | 8.9 | 8.2 | 7.2 | 7.8 | 7.1 | 7.7 | 6.5 | 6.2 | 6.0 | 6.0 | 5.8 | 5.4 | 5.5 |
| C5-750 F. | 10.1 | 5.8 | 3.7 | 5.5 | 5.9 | 5.3 | 5.8 | 5.3 | 5.8 | 5.2 | 4.8 | 5.2 | 5.2 | 4.8 | 4.8 | 4.0 |
| 750 F.+ | 82.4 | 88.7 | 91.0 | 85.6 | 85.9 | 87.5 | 86.4 | 87.6 | 86.5 | 88.3 | 89.0 | 88.8 | 88.8 | 89.4 | 89.8 | 91.5 |
| 750 F.+ CONV. | 16.1 | 10.3 | 8.5 | 14.2 | 13.9 | 12.3 | 13.4 | 12.2 | 13.3 | 11.5 | 10.8 | 11.0 | 11.0 | 10.4 | 10.0 | 8.3 |
| 750 F.+ POUR POINT F. | 20 | 15 | 10 | 10 | 15 | 10 | 10 | 10 | | 15 | 20 | 15 | 20 | 20 | 15 | 20 |
| D97 | | | | | | | | | | | | | | | | |
| V.I. | 93 | 93 | | | 94 | | 93 | 94 | | 94 | 94 | 94 | | 94 | | |

(1)pump failure
(2)hydrotreater heater failure
**estimate

TABLE 3

ADELAIDE BRIGHT STOCK PROCESSED OVER MDDW/HT-400

| Run No. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| propene, wt. % | — | — | — | 0.5 | 0.5 | 0.5 | 0.5 | 0.5* | 0.5 | 0.5 | 0.5 | 0.5 | 0.5 | .35 | .35 | .35 |
| TEMP. F. | | | | | | | | | | | | | | | | |
| (MDDW) | 560 | 560 | 580 | 585 | 585 | 585 | 585 | 600 | 600 | 600 | 600 | 600 | 600 | 600 | 600 | 600 |
| (HDT) | 570 | 570 | 570 | 570 | 570 | 570 | 570 | 570 | 570 | 570 | 570 | 570 | 570 | 570 | 570 | 570 |
| PRESS. PSI | 400 | 400 | 400 | 400 | 400 | 400 | 400 | 400 | 400 | 400 | 400 | 400 | 400 | 400 | 400 | 400 |
| LHSV | | | | | | | | | | | | | | | | |
| (MDDW) | 0.70 | 0.68 | 0.72 | 0.71 | 0.68 | 0.65 | 0.66 | 0.66 | 0.71 | 0.70 | 0.69 | 0.70 | 0.70 | 0.70 | 0.70 | 0.68 |
| (HDT) | 0.84 | 0.82 | 0.86 | 0.80 | 0.81 | 0.78 | 0.79 | 0.80 | 0.85 | 0.84 | 0.83 | 0.84 | 0.84 | 0.84 | 0.84 | 0.82 |
| H2 CIRC | 2500 | 2500 | 2500 | 2500 | 2500 | 2500 | 2500 | 2500 | 2500 | 2500 | 2500 | 2500 | 2500 | 2500 | 2500 | 2500 |

TABLE 3-continued

ADELAIDE BRIGHT STOCK PROCESSED OVER MDDW/HT-400

| (SCF/BBL) | | | | | | | | | | | | | | | | |
|---|---|---|---|---|---|---|---|---|---|---|---|---|---|---|---|---|
| DAYS ON-STREAM | 1 | 2 | 3 | 5 | 7 | 8 | 9 | 10 | 11 | 12 | 14 | 15 | 17 | 18 | 19 | 21 |
| PROD. WT. %) | | | | | | | | | | | | | | | | |
| METHANE | .03 | .03 | .04 | .04 | .04 | .04 | .03 | .05 | .05 | .05 | .04 | .04 | .03 | .03 | .03 | .03 |
| ETHANE | .08 | .08 | .11 | .12 | .11 | .11 | .10 | .15 | .15 | .15 | .12 | .12 | .11 | .11 | .10 | .10 |
| ETHANE | — | — | — | — | — | — | — | — | — | — | — | — | — | — | — | — |
| PROPANE | 2.92 | 2.55 | 3.02 | 3.15 | 2.91 | 2.80 | 2.44 | 3.31 | 3.34 | 3.19 | 2.68 | 2.57 | 2.31 | 2.31 | 2.12 | 2.04 |
| PROPENE | — | — | — | — | — | — | — | — | — | — | — | — | — | — | — | — |
| ISOBUTANE | 1.93 | 1.72 | 1.98 | 2.10 | 2.00 | 1.97 | 1.73 | 2.27 | 2.31 | 2.28 | 1.99 | 1.96 | 1.82 | 1.85 | 1.73 | 1.71 |
| n-BUTANE | 2.15 | 1.91 | 2.02 | 2.09 | 1.99 | 1.94 | 1.71 | 2.12 | 2.21 | 2.16 | 1.89 | 1.86 | 1.72 | 1.75 | 1.64 | 1.61 |
| BUTENES | — | — | — | — | — | — | — | — | — | — | — | — | — | — | — | — |
| TOTAL C4- | 7.1 | 6.3 | 7.2 | 7.5 | 7.1 | 6.9 | 6.0 | 7.9 | 8.0 | 7.8 | 6.7 | 6.5 | 6.0 | 6.0 | 5.6 | 5.5 |
| C5-750 F | 5.2 | 4.6 | 4.8 | 5.3 | 5.1 | 5.3 | 4.7 | 6.0 | 6.4 | 6.4 | 5.5 | 6.5 | 5.1 | 5.5 | 5.3 | 5.4 |
| 750 F+ | 87.7 | 89.1 | 88.0 | 87.2 | 87.8 | 87.8 | 89.3 | 86.1 | 85.6 | 85.8 | 87.8 | 87.0 | 88.9 | 88.5 | 89.1 | 89.1 |
| % Conv. 750 F+ | 12.3 | 10.9 | 12.0 | 12.3 | 11.7 | 11.7 | 10.2 | 13.4 | 13.9 | 13.8 | 11.7 | 12.5 | 10.6 | 11.1 | 10.6 | 10.6 |
| POUR POINT °F. | 15 | 30 | 15 | 15 | 25 | 20 | | | 20 | | 25 | 30 | 35 | 35 | 35 | 35 |
| V.I. | 93 | | 93 | 94 | | 95 | | | 94 | | 95 | | | | | |
| RUN NO. | 17 | 18 | 19 | 20 | 21 | 22 | 23 | 24 | 25 | 26 | 27 | 28 | 29 | 30 | 31 | 32 |
| propene, wt. % | — | .35 | .35 | .35 | .35 | .35 | — | .35 | .35 | .35 | .35 | .35 | .35 | .35 | .35 | .35 |
| TEMP. F. | | | | | | | | | | | | | | | | |
| (MDDW) | 600 | 625 | 625 | 625 | 625 | 625 | 625 | 650 | 650 | 650/660 | 660 | 660 | 660 | 660 | 660 | 660 |
| (HDT) | 570 | 570 | 570 | 570 | 570 | 570 | 570 | 570 | 570 | 570 | 570 | 580 | 580 | 580 | 580 | 580 |
| PRESS. PSI | 400 | 400 | 400 | 400 | 400 | 400 | 400 | 400 | 400 | 400 | 400 | 400 | 400 | 400 | 400 | 400 |
| LHSV | | | | | | | | | | | | | | | | |
| (MDDW) | 0.69 | 0.71 | 0.69 | 0.72 | 0.74 | 0.72 | 0.69 | 0.61 | 0.67 | 0.68 | 0.68 | 0.68 | 0.75 | 0.75 | 0.75 | 0.75 |
| (HDT) | 0.83 | 0.85 | 0.82 | 0.86 | 0.86 | 0.87 | 0.83 | 0.73 | 0.81 | 0.81 | 0.81 | 0.81 | 0.90 | 0.90 | 0.90 | 0.90 |
| H2 CIRC. | 2500 | 2500 | 2500 | 2500 | 2500 | 2500 | 2500 | 2500 | 2500 | 2500 | 2500 | 2500 | 2500 | 2500 | 2500 | 2500 |
| (SCF/BBL) | | | | | | | | | | | | | | | | |
| TOS-DAYS | 22 | 23 | 24 | 25 | 26 | 28 | 29 | 30 | 32 | 35 | 37 | 39 | 42 | 44 | 46 | 49 |
| PROD. WT. % | | | | | | | | | | | | | | | | |
| METHANE | .03 | .04 | .04 | .04 | .03 | .03 | .03 | .04 | .04 | .05 | .05 | .04 | .04 | .04 | .03 | .04 |
| ETHANE | .10 | .15 | .14 | .15 | .12 | .11 | .11 | .19 | .18 | .21 | .21 | .20 | .18 | .18 | .17 | .18 |
| ETHANE | — | — | — | — | — | — | — | — | — | — | — | — | — | — | — | — |
| PROPANE | 1.86 | 2.48 | 2.33 | 2.43 | 1.87 | 1.81 | 1.65 | 2.31 | 2.43 | 2.58 | 2.58 | 2.45 | 2.14 | 2.09 | 1.98 | 2.04 |
| PROPENE | — | — | — | — | — | — | — | — | — | — | — | — | — | — | — | — |
| ISOBUTANE | 1.61 | 2.02 | 1.95 | 2.08 | 1.64 | 1.61 | 1.52 | 1.94 | 2.07 | 2.15 | 2.15 | 2.06 | 1.88 | 1.85 | 1.77 | 1.87 |
| n-BUTANE | 1.52 | 1.77 | 1.71 | 1.83 | 1.45 | 1.41 | 1.33 | 1.55 | 1.72 | 1.76 | 1.77 | 1.71 | 1.57 | 1.54 | 1.49 | 1.57 |
| BUTENES | — | — | — | — | — | — | — | — | — | — | — | — | — | — | — | — |
| TOTAL C4- | 5.1 | 6.5 | 6.2 | 6.5 | 5.1 | 5.0 | 4.6 | 6.0 | 6.5 | 6.7 | 6.8 | 6.5 | 5.8 | 5.7 | 5.5 | 5.7 |
| C5-750 F | 5.2 | 5.3 | 5.4 | 6.0 | 5.0 | 5.1 | 5.1 | 5.1 | 5.7 | 6.0 | 5.9 | 6.5 | 5.8 | 6.0 | 5.9 | 6.0 |
| 750 F+ | 89.7 | 88.2 | 88.4 | 87.5 | 89.9 | 89.9 | 9.03 | 88.9 | 87.8 | 87.3 | 87.3 | 87.1 | 88.4 | 88.3 | 88.6 | 88.3 |
| % Conv. 750 F+ | 10.0 | 11.4 | 11.2 | 12.2 | 9.7 | 9.8 | 9.7 | 10.8 | 11.8 | 12.4 | 12.3 | 12.6 | 11.2 | 11.3 | 11.0 | 11.3 |
| POUR POINT °F | 35 | 25 | 25 | 40 | 40 | 40 | 45 | 25 | 25 | 25 | 20 | 25 | 15 | 30 | 35 | 35 |
| V.I. | | | 95 | | | | | | | | | | | | | |

*olefin off 3 hrs. during temp. increase

What is claimed is:

1. A method for reducing the aging rate of a highly siliceous zeolite catalyst used in the catalytic hydrodewaxing of 399° C.+ (750° F.+) hydrocarbon feedstock, which method comprises the addition of from about 0.1 to 10 weight percent olefins to said feedstock prior to its exposure to said catalyst under hydrocarbon hydrodewaxing conditions which include a hydrogen pressure of between about 50 to 400 psig.

2. The method of claim 1 wherein olefin-containing hydrocarbon mixtures are added to said feedstocks.

3. The method of claim 2 wherein said olefins include propene.

4. The method of claim 2 wherein said olefins include 1-hexene.

5. The method of claim 1 wherein said contact of feedstock with said catalyst occurs in downflow trickle bed reactor.

6. The method of claim 5 wherein said feedstock is catalytically hydrodewaxed in a reactor system comprising a first stage for catalytically hydrodewaxing the feedstock by contacting with said highly siliceous zeolite catalyst and a second stage for hydrotreating the effluent from the first stage with a hydrotreating catalyst.

7. The method of claim 6 wherein said highly siliceous zeolite catalyst is selected from the group consisting of ZSM-5, ZSM-5/ZSM-11 intermediate, ZSM-11, ZSM-12, ZSM-23, ZSM-35, ZSM-38 and ZSM-48; and said hydrotreating catalyst comprises at least one Group VIII metal or its oxides or sulfides and at least one Group VIA metal or its oxides or sulfides on a refractory base support.

8. The method of claim 7 wherein said highly siliceous zeolite catalyst is ZSM-5 and the Group VIA metal of said hydrotreating catalyst is molybdenum, and the Group VIII metal of said hydrotreating catalyst is cobalt.

9. The method of claim 6 wherein the hydrodewaxing conditions include a temperature of between about 260° C. and 427° C., a hydrogen circulation rate of between about 500 and 10,000 s.c.f.b. and a LHSV of between about 0.1 and 5.

10. The method of claim 6 wherein the hydrodewaxing conditions include a hydrogen pressure of between about 200 and 400 psig, a temperature of between about 260° C. and 427° C., a hydrogen circulation rate of between about 1500 and 3000 s.c.f.b. and a LHSV of between about 0.3 and 3.

11. The method of claim 6, wherein said hydrocarbon feedstock is a distillate feedstock.

12. The method of claim 6, wherein said hydrocarbon feedstock is a lube feedstock.

13. The method of claim 1 wherein about 0.25 to about 2 weight percent olefin is added to the feedstock.

14. The method of claim 1 wherein about 0.02 to 2 moles of olefin are added to each liter of the feedstock.

15. The method of claim 1 wherein about 0.02 to 0.4 moles of olefin are added to each liter of the feedstock.

16. The method of claim 1 wherein said catalyst has been hydrogen reactivated.

17. The method of claim 1 wherein said catalyst is fresh catalyst.

* * * * *

UNITED STATES PATENT AND TRADEMARK OFFICE

CERTIFICATE OF CORRECTION

PATENT NO. : 4,443,327

DATED : April 17, 1984

INVENTOR(S) : David S. Shihabi and John D. Lutner

It is certified that error appears in the above-identified patent and that said Letters Patent is hereby corrected as shown below:

Col. 13: Table 2, line 2: Change "1-Hexane" to --1-Hexene--;
line 33: Change "1-Hexane" to --1-Hexene--.

Signed and Sealed this

Thirty-first Day of January, 1989

*Attest:*

DONALD J. QUIGG

*Attesting Officer*

*Commissioner of Patents and Trademarks*